US008726419B2

(12) United States Patent
Vahey

(10) Patent No.: US 8,726,419 B2
(45) Date of Patent: May 20, 2014

(54) HEAD AND NECK STABILIZER FOR TRAVEL

(76) Inventor: Michael Vahey, Williamsburg, VA (US)

( * ) Notice: Subject to any disclaimer, the term of this patent is extended or adjusted under 35 U.S.C. 154(b) by 277 days.

(21) Appl. No.: 13/102,033

(22) Filed: May 5, 2011

(65) Prior Publication Data

US 2011/0271421 A1 Nov. 10, 2011

Related U.S. Application Data

(60) Provisional application No. 61/331,487, filed on May 5, 2010, provisional application No. 61/442,042, filed on Feb. 11, 2011.

(51) Int. Cl.
*A42B 1/18* (2006.01)
*A47C 20/00* (2006.01)

(52) U.S. Cl.
USPC ..... 2/173; 3/636; 3/640

(58) Field of Classification Search
USPC ..... 2/172, 173, 15; 5/636, 640; 297/393
See application file for complete search history.

(56) References Cited

U.S. PATENT DOCUMENTS

| | | | | | |
|---|---|---|---|---|---|
| 1,807,475 | A * | 5/1931 | Gibson | 2/15 |
| 2,367,459 | A * | 1/1945 | Corley | 2/209 |
| 3,541,608 | A * | 11/1970 | Otwell | 2/15 |
| 3,780,379 | A * | 12/1973 | Kampman | 2/15 |
| 4,520,510 | A * | 6/1985 | Daigle | 2/452 |
| 4,576,150 | A * | 3/1986 | Auracher | 602/18 |
| 4,679,263 | A * | 7/1987 | Honer | 5/640 |
| 4,712,254 | A * | 12/1987 | Daigle | 2/452 |
| 4,776,049 | A * | 10/1988 | Perron | 5/640 |
| 5,038,412 | A * | 8/1991 | Cionni | 2/209 |
| 5,378,042 | A * | 1/1995 | Daneshvar | 297/393 |
| 6,088,836 | A * | 7/2000 | de Cordova | 2/171 |
| 6,223,748 | B1 * | 5/2001 | Chaves et al. | 128/857 |
| 6,363,285 | B1 * | 3/2002 | Wey | 607/100 |
| 6,641,220 | B2 * | 11/2003 | Clegg | 297/397 |
| 6,651,256 | B1 * | 11/2003 | Swift | 2/171 |
| 7,322,693 | B2 * | 1/2008 | Abraham | 351/158 |
| 7,428,763 | B2 * | 9/2008 | Hightower | 5/636 |
| D596,382 | S * | 7/2009 | Dolby | D2/877 |
| 7,603,723 | B2 * | 10/2009 | Ulm | 2/15 |
| 7,832,802 | B2 * | 11/2010 | Ehlers et al. | 297/393 |
| 8,001,624 | B1 * | 8/2011 | Leedom | 2/425 |
| D668,703 | S * | 10/2012 | Gordon et al. | D16/301 |
| 2004/0098789 | A1 * | 5/2004 | Carey | 2/173 |
| 2005/0015851 | A1 * | 1/2005 | Kaufman | 2/208 |
| 2008/0184489 | A1 * | 8/2008 | Pham | 5/636 |
| 2008/0216211 | A1 * | 9/2008 | Dolby | 2/206 |
| 2008/0216244 | A1 * | 9/2008 | Minton | 5/640 |
| 2009/0193559 | A1 * | 8/2009 | Ritchey | 2/15 |
| 2009/0205107 | A1 * | 8/2009 | Coba | 2/171.2 |
| 2009/0271904 | A1 * | 11/2009 | Bentley | 2/15 |
| 2009/0287282 | A1 * | 11/2009 | Biser et al. | 607/109 |
| 2010/0229275 | A1 * | 9/2010 | Wilson | 2/15 |
| 2010/0301655 | A1 * | 12/2010 | Mezger | 297/397 |
| 2011/0178585 | A1 * | 7/2011 | Biser | 607/109 |
| 2012/0210516 | A1 * | 8/2012 | Popovic | 5/640 |

* cited by examiner

*Primary Examiner* — Amber Anderson
(74) *Attorney, Agent, or Firm* — Brian J. Teague

(57) ABSTRACT

A head and neck support device includes first and second head support members that may be positioned in complimentary opposing locations to a rear area of the head. Each head support member comprises a substantially rectangular shaped pillow that may be affixed to headwear (e.g., hat) or a headband. The first and second head support members are configured to complimentarily support and distribute a weight of the head to substantially bypass a neck or the wearer and effectuate translation of the forces of gravity (somewhat equally) to the sides of the head of the wearer.

6 Claims, 6 Drawing Sheets

HEAD AND NECK STABILIZER FOR TRAVEL

COPENDING APPLICATION

This application claims priority benefit of U.S. Provisional Application Ser. No. 61/331,487, titled "Head/Neck Stabilizer for Travel," filed May 5, 2010, having the same inventor of the instant patent application and which is incorporated herein by reference as if set forth in full below.

This application claims priority benefit of U.S. Provisional Application Ser. No. 61/442,042, titled "Head/Neck Stabilizer for Travel," filed Feb. 2, 2011, having the same inventor of the instant patent application and which is incorporated herein by reference as if set forth in full below.

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND

I. Field

The invention relates to head and neck support.

II. Background

The human neck has a natural Lordotic Curve, also known as the "C" curve. In order to maintain a healthy "C" curve, a person must keep the head centrally located over the body. This is often difficult to accomplish when resting, reading, watching television, traveling on an airplane or in a vehicle, and performing tasks that require continuously looking in a downward direction, or if a person has poor posture. The inevitable force of gravity pulls the head downward such that the neck experiences certain levels of inversion in any one of a plurality of directions with respect to the remainder of the spine. Head and/or neck support, such as when sleeping upright or reading, can reduce fatigue, relieve pain in the neck and shoulder region, and prevent stiffness and other neck-related complications.

Currently, there are numerous neck support items available for recreational and non-medical use. These neck pillows are often shaped like the letter "U" or a horseshoe and are simply placed around the user's neck with an open end in the front. The goal of these horseshoe shaped pillows is to offer orthopedic support and lessen pain in the neck and back while making it easier to fall asleep in an otherwise less accommodating setting.

The neck pillows can be used when sitting up. The user in a sitting and upright position slips the pillow around the neck which may prop up the user's head as the head tilts (under the force of gravity) during a sound sleep. However, the user's head is still subject to tilt forward and wobble around during a sound sleep when traveling.

The main goal of any kind of neck pillow is to provide support for the head and neck and to limit inversion of the neck with respect to the spine as the head falls under the force of gravity. However, neck pillows limit inversion only slightly and provide only a minimal level of comfort, as the neck will still tend to invert and wobble under the weight of the head, when the wearer is sleeping. Furthermore, the U-shaped profile does little by way of cradling or supporting the mental protuberance as the head rolls sideways under the force of gravity.

SUMMARY

The aforementioned problems, and other problems, are reduced, according to exemplary embodiments, by the head and neck support device.

According to an exemplary embodiment, a head and neck support device comprises first and second head support members that may be positioned in complimentary opposing locations to a rear area of the head. Each head support member comprises a substantially rectangular shaped pillow that may be affixed to headwear (e.g., hat) or a headband. The head support members may be alternate shapes, such as what might be considered a stuffed node that is substantially shaped like a small child's fist. According to these embodiments, the first and second head support members are configured to complimentarily support and distribute a weight of the head to substantially bypass a neck of the wearer and effectuate translation of the forces of gravity (somewhat equally) to the sides of the head of the wearer.

In an exemplary embodiment, a comfort headband member includes the first and second head support members symmetrically affixed on the rear or back side of the headband. The headband member may be the type commonly used for sports as "sweat bands". As one of ordinary skill in the art appreciates, the headband may be made of alternate materials including natural fabrics (e.g., cotton), man-made fabrics, and combinations thereof. An adjustable comfort eye panel extends from a lower end of a front side, such that a wearer could position the eye panel over his or her eyes to block out the light. And, the eye panel could be attached such that flipping it up towards the headband results in the eye panel remaining in a fixed position so that the wearer's eyes are not covered. Alternatively, the eye panel may include attachment means (e.g., snap, button, hook and loop, etc.) to an exterior portion of the front headband to more securely keep the eye panel in a fixed position so that the wearer's eyes are not covered.

According to some of the embodiments of this invention, the headband is horizontally adjustable to increase or decrease in diameter and fit a variety of head sizes. The adjustability allows the organizer to be increased or decreased in length. Alternatively, the first and second head support members may include attachment means that can independently affix to a variety of hats or headgear to customize the location and placement for a particular wearer's head. In further exemplary embodiments, the headband may include one or more pockets of varying size, such as a pocket to hold earplugs, a scented sachet, and other objects.

Other devices, methods, and/or products according to embodiments will be or become apparent to one with skill in the art upon review of the following drawings and further description. It is intended that all such additional devices, methods, and/or products be included within this description, be within the scope of the present invention, and be protected by the accompanying claims.

BRIEF DESCRIPTION OF THE DRAWINGS

The exemplary embodiments, objects, uses, advantages, and novel features are more clearly understood by reference to the following description taken in connection with the accompanying figures wherein.

DESCRIPTION

The word "exemplary" is used herein to mean "serving as an example, instance, or illustration." Any configuration or design described herein as "exemplary" is not necessarily to be construed as preferred or advantageous over other configurations or designs. Furthermore, use of the words "present invention" is used herein to convey only some of the embodiments of the invention. For example, the words "present invention" would also include alternative embodiments and equivalent systems and components that one of ordinary skill in the art understands. An example is that the materials used for the exemplary embodiments may be made out of man-made materials, natural materials, and combinations thereof. And, lengths and widths (dimensions) may be varied. Still, a further example is that the apparatus or components of the apparatus may be manufactured by machine(s), human(s) and combinations thereof.

Some of the embodiments of the invention now will be described more fully hereinafter with reference to the accompanying drawings, in which exemplary embodiments are shown. This invention may, however, be embodied in many different forms and should not be construed as limited to the embodiments set forth herein. These embodiments are provided so that this disclosure will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or perspective views illustrating some of the neck support device and methods embodying this invention. The functions of the various elements shown in the figures may be provided through the use of materials that may vary in shape, attachment, size, and other physical features. Those of ordinary skill in the art further understand that the exemplary head and neck support device, and/or methods described herein are for illustrative purposes and, thus, are not intended to be limited to any particular named manufacturer or other relevant physical limitation (e.g., color of the material).

Figure 6:
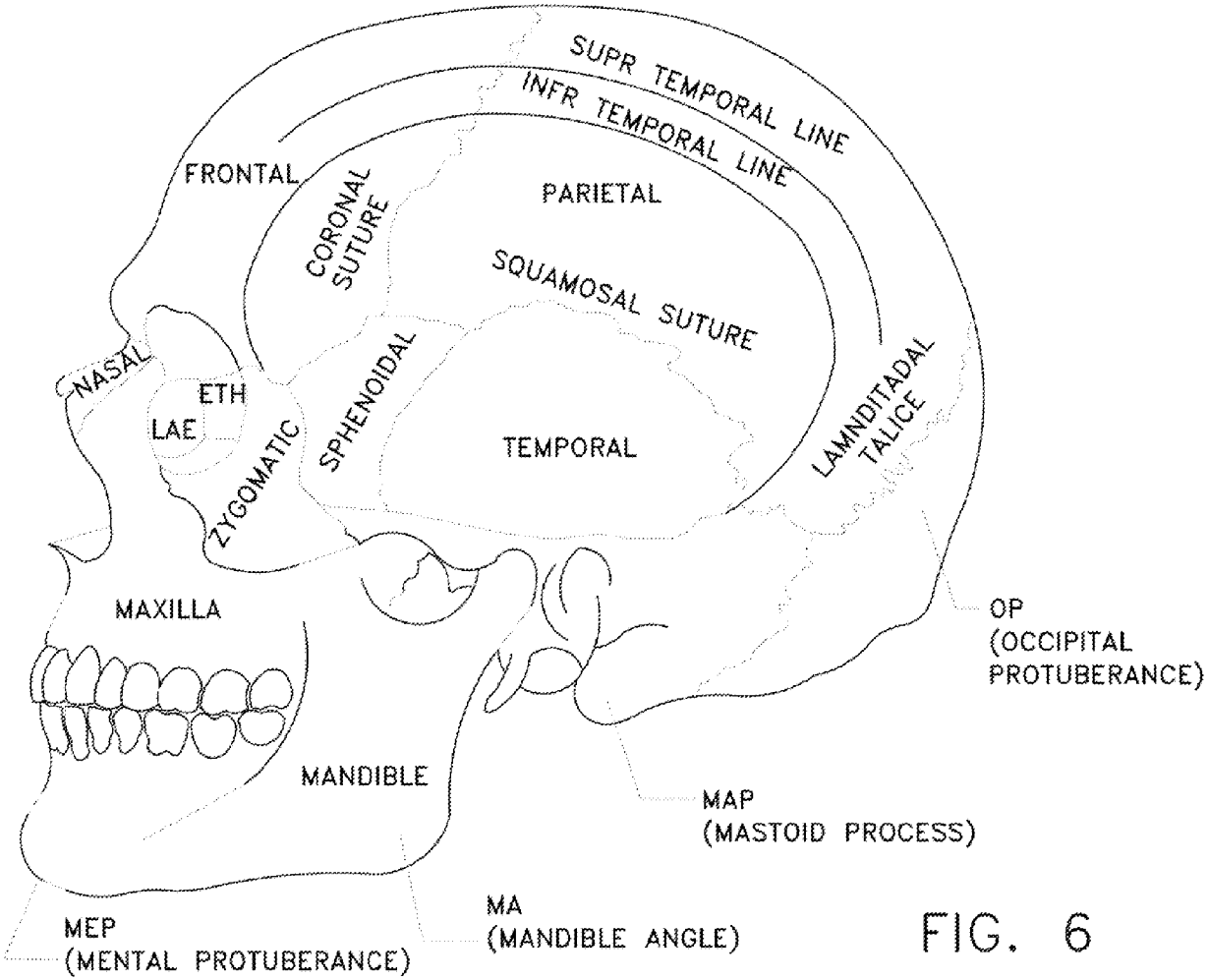
FIG. 6 illustrates a known anatomical structure of a skull.

FIG. 6 illustrates a known anatomical structure of a skull and will be referenced from time to time as the features of the present invention are described.

The head and neck support device provides comfort and support with the ability to be properly sized to fit a variety of head circumferences and/or heights. The head and neck support device provides distributed support of the head when the body is in an upright position. The head and neck support device, in an embodiment, is intended for recreational and non-medical use. A consumer may use the head and neck support device when resting, reading, watching television, traveling or performing other tasks that tend to overuse the neck muscles.

In an embodiment, the head and neck support device may substantially prevent inversion of the neck with respect to the remainder of the spine as the wearer sleeps or relaxes.

In an embodiment, the head and neck support device may prevent wobbling of the head when the wearer is asleep or relaxed so as to provide a more comfortable position in a less than accommodating setting such as when traveling in a car, plane, train, or other vehicle, which does not allow a person to rest in a reclined position.

Figure 1:
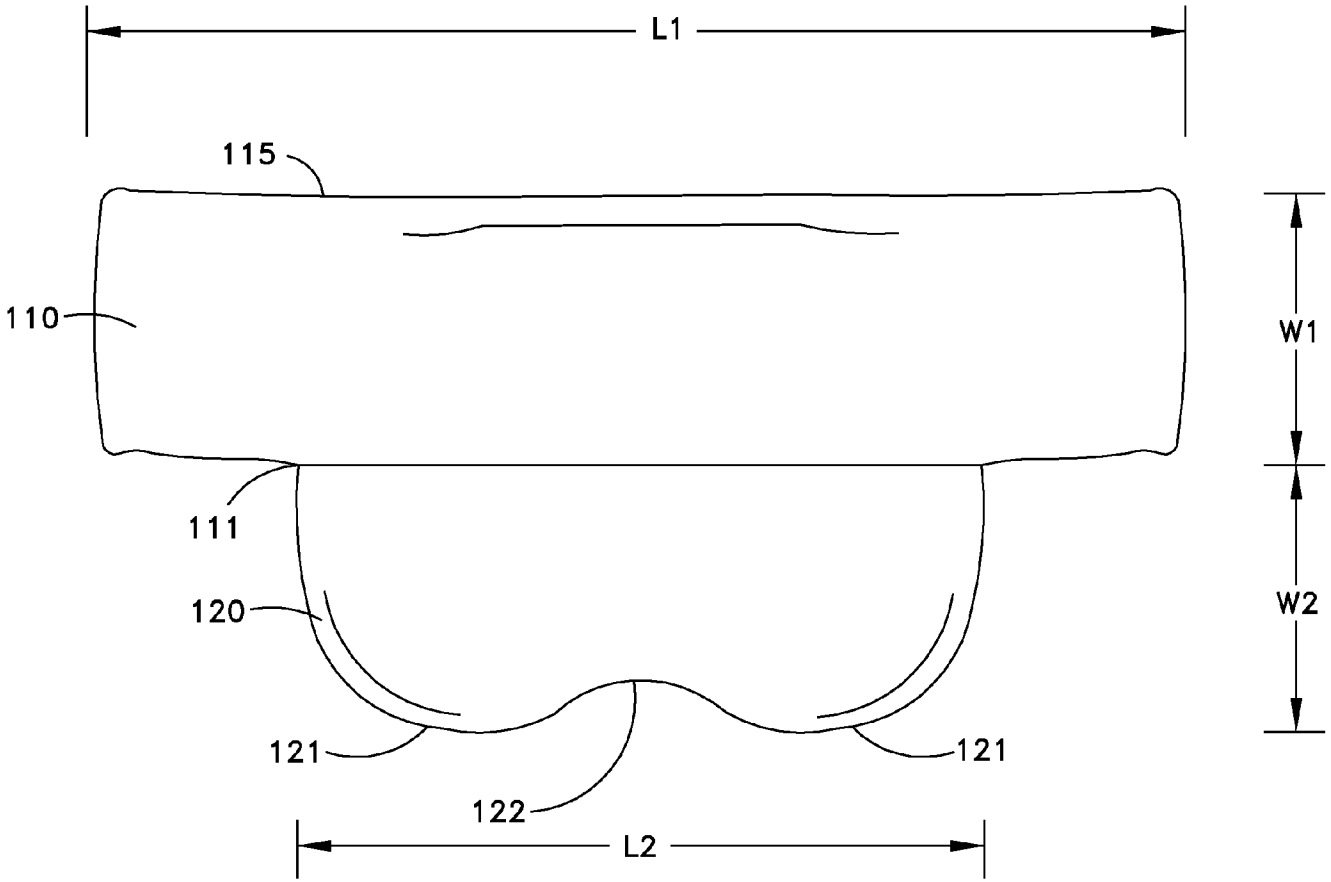
FIG. 1 illustrates a perspective front view of a head and neck support system in accordance with exemplary embodiments of the invention.
Figure 2:
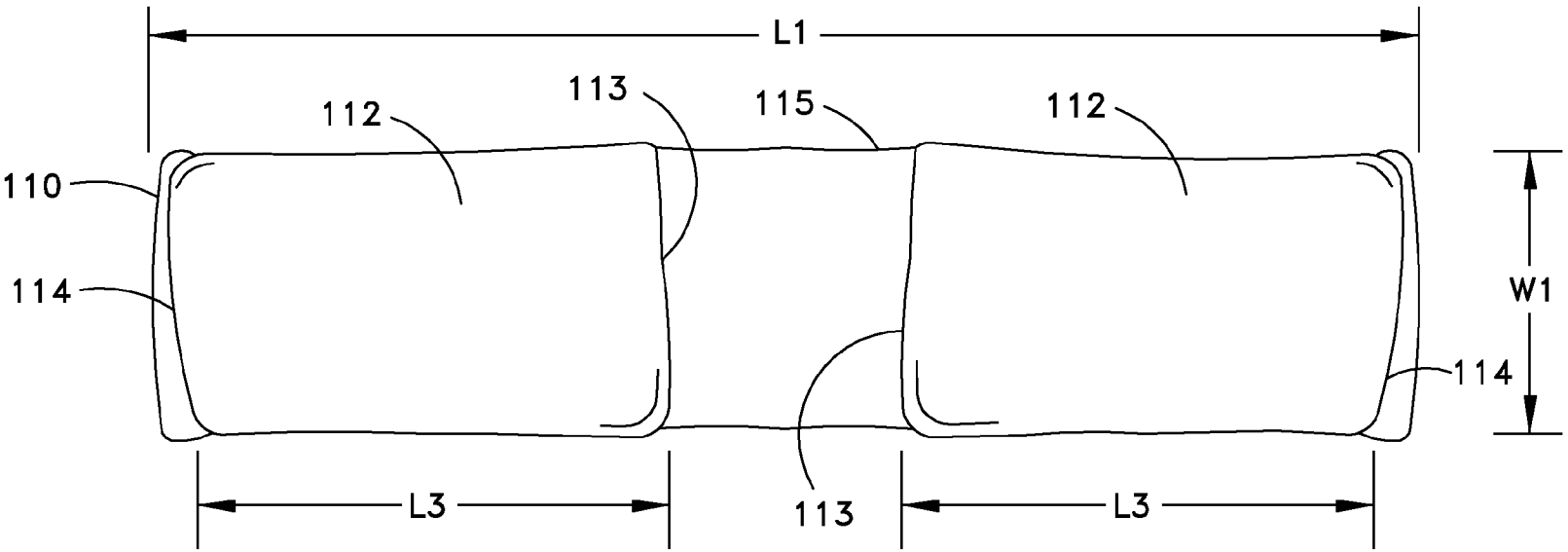
FIG. 2 illustrates a perspective rear view of a head and neck support system in accordance with exemplary embodiments of the invention.
Figure 3:
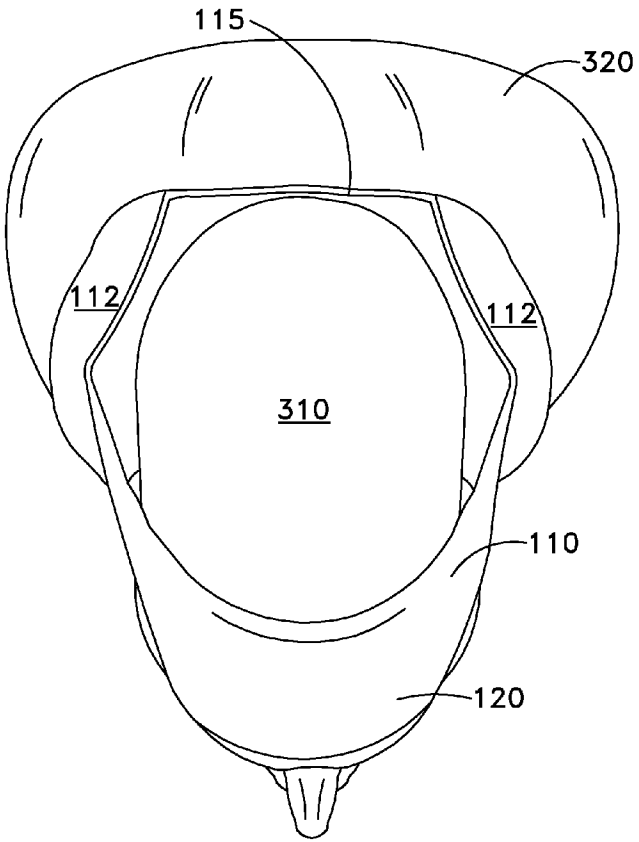
FIG. 3 illustrates a perspective top view of a head and neck support system positioned about a wearer's head in accordance with exemplary embodiments of the invention.
Figure 4:
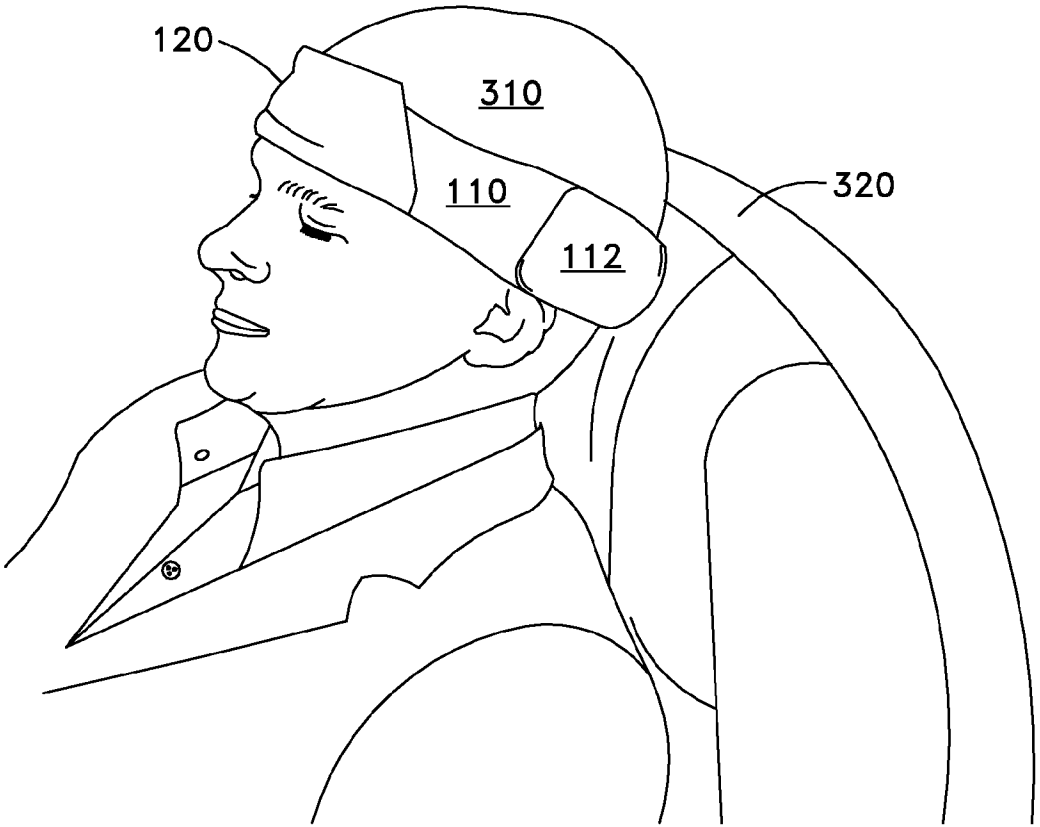
FIG. 4 illustrates a perspective side view of a head and neck support system positioned about a wearer's head in accordance with exemplary embodiments of the invention.

FIGS. 1-4 illustrate front, back, top and side perspective views of a head and neck support device (also referred to herein as the "Travel Halo"). FIGS. 1-2 show the head and neck support device itself. And, FIGS. 3-4 show the head and neck support device being worn by a wearer 310. The head and neck support device is comprised of a headband 110 having a bottom edge 111 and a top edge 115. The bottom edge 111 connects to an adjustable comfort eye panel 120 that is symmetrically contoured with longer extensions 121 to cover the eyes of a wearer and cut-away portion 122 to fit about a wearer's nose. Each first and second head support members 112 has an interior edge 113 and an exterior edge 114. According to an exemplary embodiment, the length L1 of the front headband is approximately 10.5 inches. the length L2 of the eye panel is 7.5 inches. The width W1 of the headband 110 is 2.5 inches. Similarly, the width W1 of each first and second head support member 112 is 2.5 inches with spacing of about 2 inches in between the interior edges 113 of each head support member 112. And, the width W2 of the eye panel from the bottom edge of the headband 111 to the longer extension 121 is 3 inches.

The headband 110 includes a first and second head support members 112 symmetrically affixed on the rear or back side of the headband. The headband 110 may be the type commonly used for sports as "sweat bands". The adjustable comfort eye panel 120 extends from the bottom edge 111 of a front side, such that a wearer could position the eye panel 120 over his or her eyes to block out the light. Alternatively, the eye panel 120 could be attached such that flipping it 120 up results in the eye panel 120 remaining in a fixed position so that the wearer's eyes are not covered as shown in FIG. 4. Alternatively, the eye panel 120 may include attachment means (e.g., snap, button, hook and loop, etc.) to an exterior portion of the headband 110 to secure the eye panel 120 in a fixed position so that the wearer's eyes are not covered.

Each head support member 112 comprises a substantially rectangular shaped pillow that is affixed to the headband 110. In alternate embodiments, the head support members may be alternate shapes, such as what might be considered a stuffed node that is substantially shaped like a small child's fist. According to these embodiments, the first and second head support members are configured to complimentarily support and distribute a weight of the head to substantially bypass a neck of the wearer and effectuate translation of the forces of gravity (somewhat equally) to the sides of the head of the wearer.

In one embodiment, head and neck support device of FIGS. 1-4 is configured to adapt to a wide range of head circumferences and heights. That is the headband 110 may be made of an elastic material that conforms to the shape of the wearer's head and allows comfortable, snug positioning of the first and second head support members 112. In alternate embodiments, a headband may be horizontally adjustable, such as by having a flat band that adjustably fastens to portions of adjustable ends or alternate adjustable means.

Figure 5A:
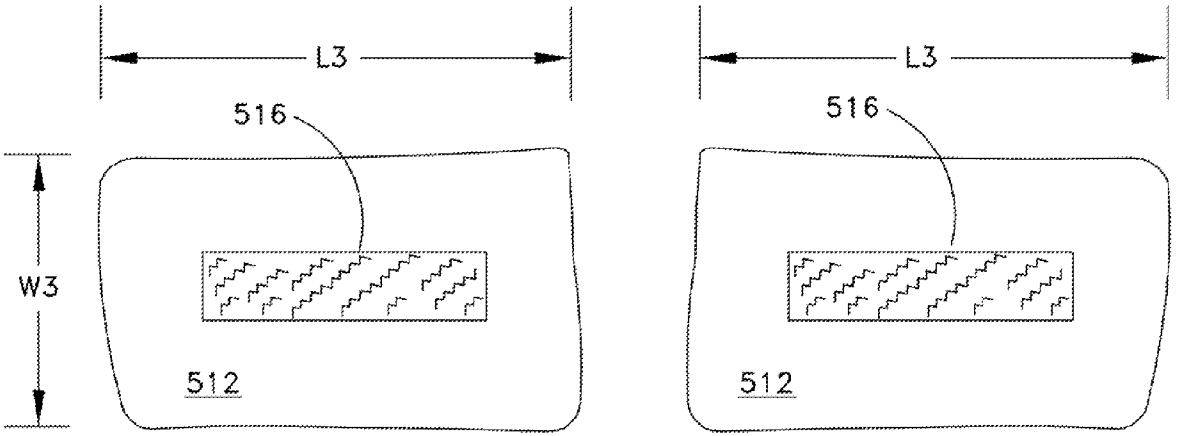
FIGS. 5A and 5B illustrates perspective views of an alternative head and neck support system in accordance with exemplary embodiments of the invention.
Figure 5B:
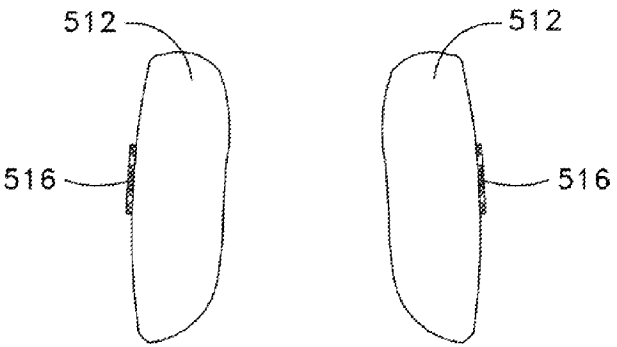

FIGS. 5A and 5B show perspective views of alternate first and second head support members 512 that may be affixed to a hat or alternate headgear via a fastening panel 516 attached to a portion of the head support member 512 that mates with the hat or headgear. The length L3 of each head support member is 3.5 inches. The width W3 of each head support member is 2.5 inches. The fastening panel 516 of each head support member 512 may couple, strap, or affix the head support member 512 to a hat (not shown) or alternate headgear (not shown) in a diametrically opposing arrangement similar to the arrangement of the first and second head support members 112 shown in FIG. 3. The first and second neck support members 512 when affixed or coupled to the hat or headgear are configured to embrace and support the head of a wearer in a diametrically opposed arrangement.

The first and second head support members 512, in an embodiment, are identical and anatomically complimentary to each other such that a head support member positioned on the left side supports the left side of the head while the head support member positioned on the right side supports the right side of the head. More specifically, the first and second head support members 512 are configured to closely embrace a left side of the head and a right side of the head.

In an embodiment, the first and second head support members 512 are configured to adapt to the wearer's anatomical profile and movements, especially about the head.

Since each of the first and second head support members 512 is essentially identical only one such member will be described in detail. The first head support member 512 comprises a rectangular shape with a convex contour, as best seen in FIG. 5B, the convex contour being configured to position a side of a wearer's head on support surface 320 of an upright seat. Specifically, each head support member 512 is positioned and configured to support the head. Each head support member 512 is position on a back (posterior) area proximate the rear INFR Temporal Line and lamnditadal talice as labeled in FIG. 6 and similarly illustrated in FIG. 3 with first and second head support members 112.

Alternate embodiments may include additional padding about the posterior or rear portion of the headband (shown as reference numeral 110 in FIGS. 1-4) to better distribute the loads carried on the first and second head support members (shown as reference numerals 112 in FIGS. 1-4). In an embodiment, a neoprene fabric (which may be the padding layer or a separate layer) may be used as the headband or may be an exterior layer that removes for washing or replacement. The neoprene fitting may also be available in a variety of colors.

In one embodiment, the fastening means for connecting the head support member with the headband (or hat or headgear) comprises a hook and loop fastening system (e.g. Velcro™). The fastening means is configured to fasten together each head support member to an exterior surface of a headband (or hat or headgear). Likewise, the fastening means may includes an alternate attachment means, such as zippers, snaps, matable affixments, ties, straps, clips, elastic, or belts. In still further embodiments, the Travel Halo can also be available in multiple sizes ranging from child sizes to adult sizes.

The Travel Halo allows the wearer to achieve, while sleeping, a more anatomically aligned head and neck with respect to the spine thus providing a more comfortable sleep. As can be readily seen, the Travel Halo provides a superior head neck support device for recreational and non-medical use. That is, the Travel Halo provides a comfort shelf configured to cradle and support the head by translating the force of gravity to the sides of the head and shoulders of the wearer, especially, when sitting upright. Its design results in a more comfortable easily obtained sleep. Additionally, the Travel Halo requires less material than the traditional U-shaped pillow and requires minimum storage space. It may easily fit into a front pocket of the wearer and is effectively easier than the U-shaped pillow to transport.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitations.

What is claimed:

1. A head support device comprising:

a headband encircling a head of a wearer;

a first head support member and a second head support member, wherein the first and second head support members are attached at complimentary opposing positions on the headband and wherein the first and second head support members engage the head of the wearer and further engage a head rest surface, thereby obstructing rotation of the head of the wearer along an axis parallel to a neck of the wearer;

a first unpadded portion and a second unpadded portion, wherein the first and second unpadded portions are disposed at complimentary opposing positions on the headband, the first and second unpadded portions spacing the first and second head support members; and an eye panel extending from the first unpadded portion of the headband; wherein an interior edge of the first head support is spaced approximately two inches from an interior edge of the second head support; and wherein the first and second head support members have exterior edges that are spaced a distance from each other longer than a length of the eye panel.

2. The head support device of claim 1 wherein each of the first head support and the second head support comprises contoured pillows having a length of approximately 3.5 inches and a width of approximately 2.5 inches.

3. The head support device of claim 1 wherein the headband is approximately 2.5 inches in width.

4. The head support device of claim 1 wherein the eye panel is approximately 3 inches in width and 7.5 inches in length.

5. The head support device of claim 1 wherein a free edge of the eye panel furthest from the headband is contoured for positioning about a face of the wearer.

6. The head support device of claim 5 wherein the first and second head support members are configured to complimentarily support and distribute a weight of the head of the wearer to each side of the head aligned with each head support member.

* * * * *